US005892888A

United States Patent [19]

Romero

[11] Patent Number: 5,892,888

[45] Date of Patent: Apr. 6, 1999

[54] MEANS FOR ELECTRICALLY HEATING A CIRCULATING FLUID IN A BASIN OR POOL

[75] Inventor: Francis Romero, Angers Cedex, France

[73] Assignee: Piscine Service Anjou SA, France

[21] Appl. No.: 654,313

[22] Filed: May 28, 1996

[51] Int. Cl.[6] ..... F24H 1/20

[52] U.S. Cl. ..... 392/453; 392/398; 392/501

[58] Field of Search ..... 392/497–499, 392/500, 501, 449, 451, 452, 453, 455, 465, 396, 397, 398

[56] References Cited

U.S. PATENT DOCUMENTS

| | | | |
|---|---|---|---|
| 4,349,434 | 9/1982 | Jaworski | 392/453 |
| 4,855,569 | 8/1989 | Wiedemann | 392/453 |
| 4,924,069 | 5/1990 | Giordani | 392/453 |

*Primary Examiner*—Tu Ba Hoang
*Attorney, Agent, or Firm*—Laff, Whitesel, Conte & Saret, Ltd.

[57] ABSTRACT

An electric heating apparatus heats a circulating fluid for a basin or pool. A section of a duct is connected, at its upstream end, to an intake duct for the fluid. Its downstream end is connected to a duct for the discharge of that fluid, this forming an end-to-end series for conducting the fluid. The apparatus includes a plurality of heating elements elongated in the direction of the elongation of the duct. The heating unit includes the heating element mounted on an elongated base and approximately parallel with the longitudinal dimension of said base. The heating unit is mounted on the duct in such a manner that the base closes an opening which is provided to facilitate the assembling of the heating unit on the duct. The heating elements are supported by a support that is movably mounted inside an opening in the base.

5 Claims, 5 Drawing Sheets

20
30
30a
30b
25aa
25ba
21c
21
21a
25a
25b
24a
24b
23a
23b
23c
24
23d
29a
24c
29b
24d
29c
22a
22c
22
22b
21b
21e
26
21d
27
26a
10a
A
10
10b
12b
13b
11b
11a
13a
12a

MEANS FOR ELECTRICALLY HEATING A CIRCULATING FLUID IN A BASIN OR POOL

BACKGROUND

The present invention relates to an electric heating apparatus meant for heating a fluid in circulation and more especially for the heating of water in a basin or a pool, etc.

An electric heating installation meant for a pool generally comprises an electric heating apparatus, a system of pipes starting from the basin for transporting the fluid to be heated toward the heating apparatus, and the heated fluid from the heating apparatus toward the basin. A circulation pump mounted in series in the piping system makes possible the circulation of the fluid to be heated.

The patent document FR-A-2 621 992 describes an electric heating apparatus for a fluid in circulation, especially for the water of a pool. This apparatus comprises a U-shaped tube provided so that it can be connected, by its upstream end, to a fluid intake duct and, by its downstream end, to a fluid discharge duct. The upper parts of the two arms are T-shaped, the T(s) receiving an elongated heating element, such as immersible heaters, that are placed approximately in the axis of the ducts that form the legs of the U.

This heating apparatus gives full satisfaction, but it nevertheless has a certain number of drawbacks: its structure is relatively fragile and complex, this increasing its cost of fabrication. Also, it is not very compact, and therefore relatively difficult to install.

Attempts have been made to remedy these drawbacks by providing a heating apparatus of the type that comprises a piping section provided to be connected to a fluid intake duct and to a fluid discharge duct, said apparatus also comprising a heating unit fixed inside said section and in the longitudinal axis of the latter. This heating unit is made up of a metallic plate under which there is set, by means of threaded sockets, a heating element of the coil type. Such an apparatus is described in the American patent document U.S. Pat. No. 4,924,069.

A major drawback of this plate is found in the fact that in order to proceed to the replacement of the heating element it is necessary, each time, to remove from under the place the sockets for the fixation of that heating element.

SUMMARY

The purpose of the present invention is to offer an electric heating apparatus for a fluid, of the aforementioned type, the structure of which is such that the heating element is easily exchangeable.

To that end, such a heating apparatus for a fluid in circulation, and more especially for the water in pools, comprises a section of pipe provided so that it can be connected, by its upstream end, to a intake duct of that fluid and, by its downstream end, to a discharge duct for this fluid, said apparatus further comprising an elongated heating element (located) approximately in the axis of this section of duct, and a heating unit made up of an elongated base on which this heating element is mounted in projection, the axis of this heating element being approximately parallel to the longitudinal dimension of the mentioned base, this heating unit being mounted on the above-mentioned section of duct in such manner that the above base closes a port provided to permit the passage of the above heating element when this heating unit being mounted on that section of duct.

This heating apparatus is characterized in that the above heating element is supported on a support, which is mounted movable inside an opening of the above-mentioned base.

According to another characteristic of the invention, this heating element is constituted by a plurality of immersible heaters.

According to another characteristic of the invention the above-mentioned base carries a unit for the governing and the regulating of the heating element.

According to another characteristic of the invention this base is equipped with a rate of water flow sensor that projects on the side of the heating element, this sensor being located upstream from the heating element inside the above-mentioned section of duct.

According to another characteristic of the invention, the above-mentioned heating apparatus is connected to intake and discharge ducts, by locking and unlocking means.

The above-mentioned characteristics of the invention, as well as others, will appear more clearly upon reading of the following description of one example of execution, this description being given relative to the attached drawing in which:

DETAILED DESCRIPTION OF PREFERRED EMBODIMENTS

Figure 1:
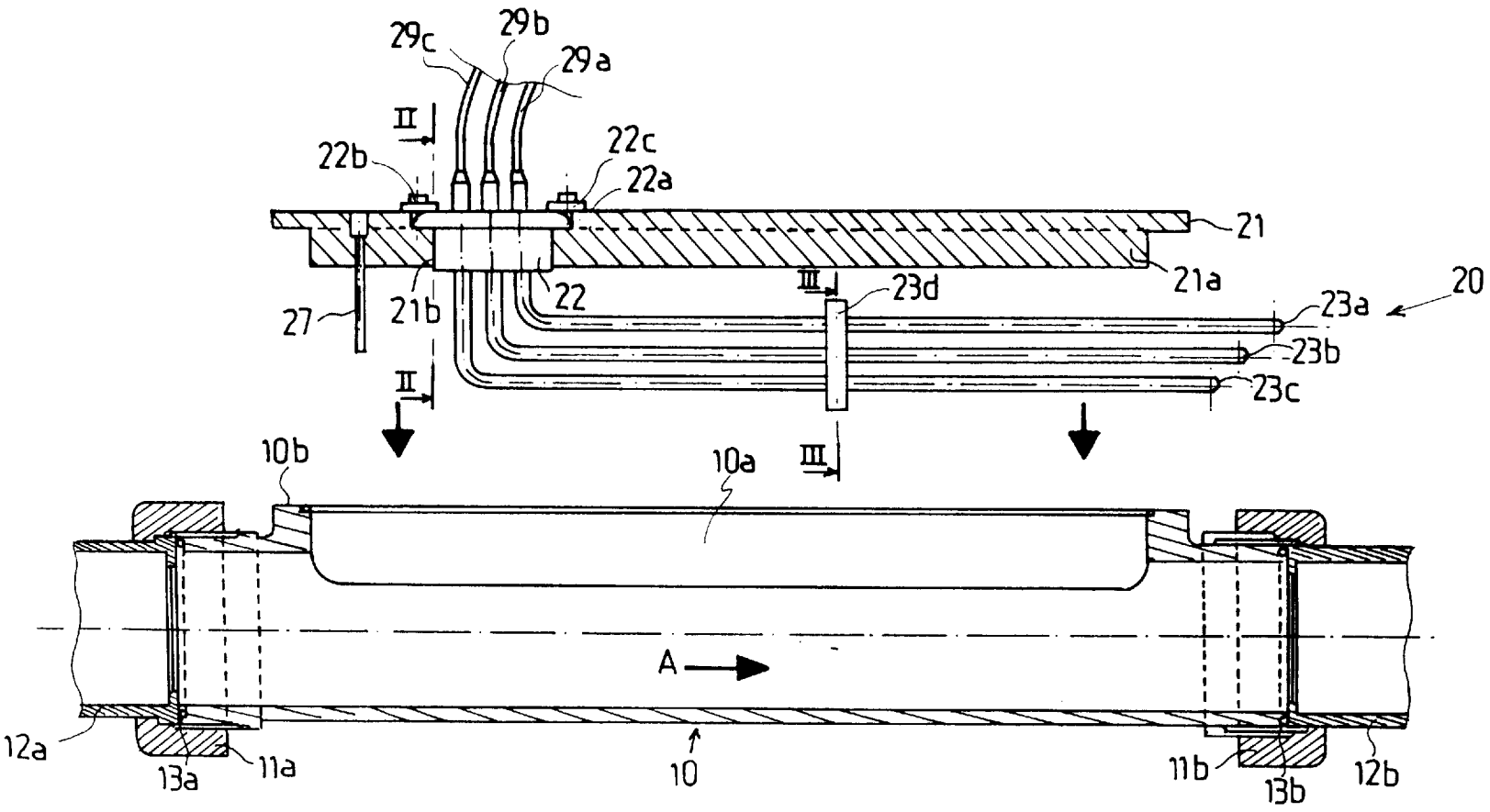
FIG. 1 is a view in section along a median longitudinal plane of an apparatus according to the invention, the section of duct of this apparatus and its heating unit being shown in exploded view.

In the example of execution in FIG. 1, the heating apparatus according to the invention is made up of a heating unit 20 mounted on a section of duct 10.

The heating unit 20 is made up of a base 21 that comprises a seat or subbase 21*a* approximately rectangular in shape, equipped, on its lower surface, with a centering member. This latter is oblong in shape and it has rounded ends that form a half-circle. The base 21 is pierced with a perforation 21*b* into which there is fitted and set a cylindrical support 22 for the heating element, which element is made up, here, of two rows of three immersible heaters 23*a*, 23*b*, 23*ac* each, (the second row of immersible heaters being placed symmetrically to the first one, relative to the section plane in FIG. 1, it is not shown).

According to a characteristic of the invention, the duct that forms the envelope of each immersible heater is made of titanium or of a material known under the trade name of Incoloy.

Figure 2:
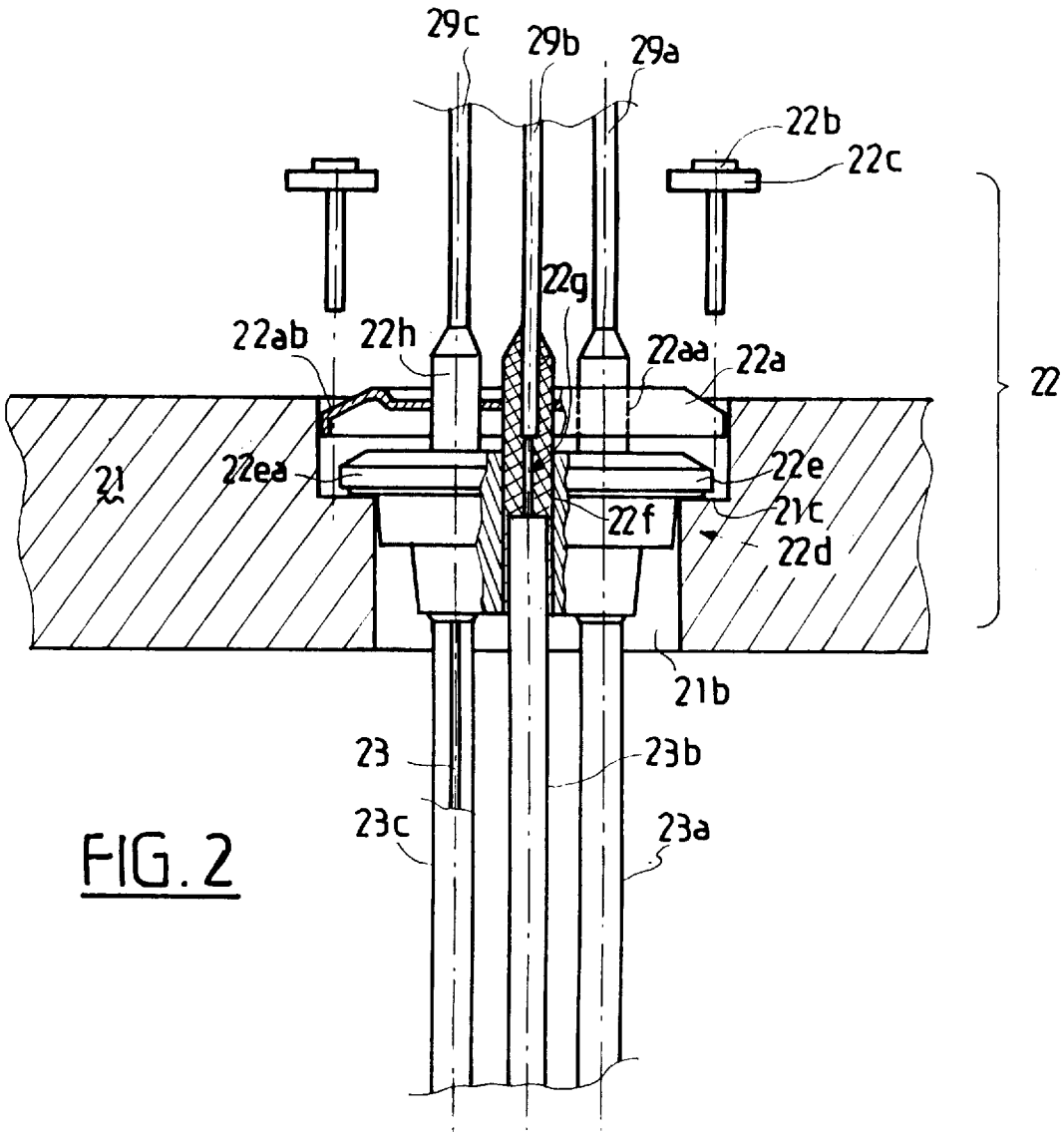
FIG. 2 is a partial section in exploded view of the support of the heating element for the apparatus according to the invention.

There is shown in FIG. 2 an exploded which of the support 22 for the immersible heaters 23*a*, 23*b*, and 23*c*.

This support 22 comprises, in its lower part, a flange 22*d* provided to ensure the tightness of the section 10 of duct, when the heating unit 20 is installed inside said section 10 of duct. The flange 22*d* ends with a collar 22*e* in its upper part, that is provided to rest on a shoulder 21*c* arranged inside the perforation 21*b* of the base 21. The material of the flange 22*d* advantageously is an elastomer such as a terpolymer of ethylene, of propylene and of diene (this material is known by the acronym EPDM).

Longitudinal perforations 22*f* traverse the flange 22*d* through and through, and they are provided to lodge the ends of cables 29*a*, 29*b*, and 29*c* that respectively are soldered to the electric terminals of resistances 23 of the immersible heaters 23*a*, 23*b* and 23*c*, so as to feed current to the latter. In practice, as shown in the part of FIG. 2 that is a section view, once the soldering points 22*g* have been executed, the above ends of cables 29*a*, 29*b* and 29*c* and of the resistances 23 are covered by compound-filling, with a sheath 22*h* made up of a hard insulating material, such as hypalon. The diameter of each sheath 22*h* is such that the latter is mounted by force into the perforations 22*f*.

Support 22 comprises a plate or shield 22*a* provided to cap the collar 22*e* of the flange 22*d*. For the assembling of the flange 22*d* onto the base 21, stirrups 22*c* take their support on the one part on the base 21 itself and, on the other part, on the plate or shield 22*a*, and they are tightened by means of crews screwed into the base 21.

The plate or shield 22*a* is equipped with openings 22*aa* having the same diameter as the above-mentioned perforations 22*f*, that are provided for the lodging of the above sheaths 22*g*. The plate or shield 22*a* has a curved-in edge 22*ab* that is provided so that it will practically fit against the edge 22*ea* of the collar 22*e*. Preferably this plate or shield 22*a* is made of zinc-coated steel.

It is easy to understand that the elasticity of the material forming the flange 22*d* makes it possible to ensure tightness, on the one part along the aforementioned collar 22*e*, because the latter is tightened by the plate or shield 22*a* and, on the other part, between the external surfaces of the sheaths 22*g* and the surfaces of the perforations 22*f*. It will moreover, be noted that the aforementioned screwing of the plate or shield 22*a* onto the base 21 allows for a distribution of the tightening force over the entirety of the upper surface of the collar 22*e*, this further improving the tightness of the section 10 of duct.

As it may be seen in FIG. 1, each immersible heater 23*a*, 23*b*, or 23*c*, following a short section that comes out of the flange 22*d*, forms a 90° elbow and is extended by a long linear section. The linear sections of the immersible heaters 23*a*, 23*b*, 23*c* are joined together by a means 23*d* that maintains their spacing, and shown in detail in FIG. 3, and they extend approximately parallel to the longitudinal direction of base 21. Besides, they belong to a same plan perpendicular to the seat or subbase 21*a* and they end beyond the ends of that seat or subbase 21*a*.

Said means 23*d* for maintaining the spacing between the immersible heaters 23*a*, 23*b* and 23*c* is made up of a crosspiece that is mounted between the two rows of immersible heaters 23*a*, 23*b*, and 23*c*, in a position perpendicular to the planes that respectively contain the two rows. The crosspiece 23*d* comprises, in each one of its sides provided to be applied against one of the above-mentioned rows, concavities 23*da* provided to hold the immersible heaters 23*a*, 23*b* and 23*c* of the mentioned row. Each concavity 23*da* is equipped with small peaks 23*db* in the shape of a truncated cone, that are provided to immobilize the corresponding immersible heaters 23*a*, 23*b* or 23*c*. The two aforementioned lodging alignments are connected between themselves by several sections 23*dc* of parallel shafts, so that the crosspiece 23*d* has a shape that is approximately rectangular and is non-deformable.

It will be noted that the very much cut-out shape of the crosspiece 23*d* makes it possible to prevent its forming an obstacle to the flowing of the fluid through the section 10 of duct, something that would cause too important losses of pressure.

Figure 4:
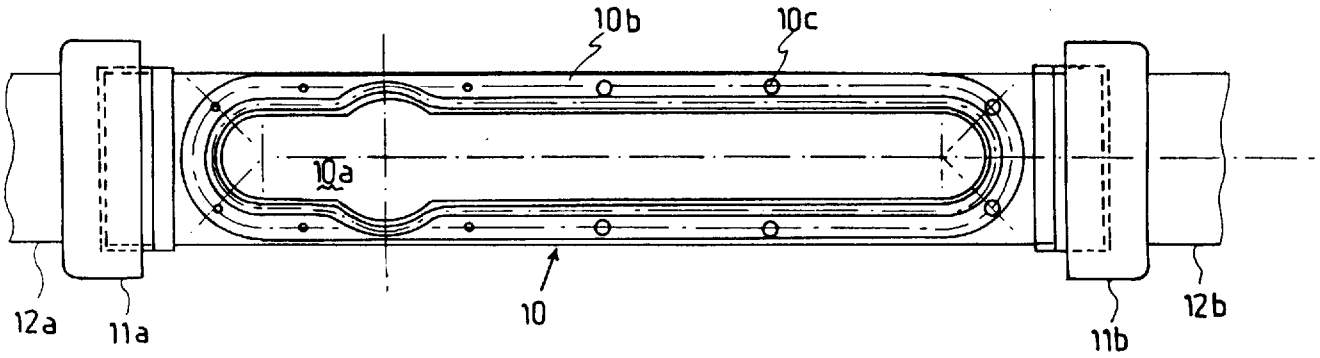
FIG. 4 is a view from the top of a section of the duct that constitutes one element of an apparatus according to the invention.

The section 10 of duct, seen from the top in FIG. 4, is constituted by a linear duct, having a circular section for example, and it is arranged so that it can be connected, by its upstream end, to a duct 12*a* that feeds the fluid and, by its downstream end, to a duct 12*b* that discharges the fluid. The section 10 of duct being rectilinear, the ducts 12*a* and 12*b* of necessity have coaxial ends. Screwing rings 11*a* and 11*b* ensure the maintaining of the connection while ring joints 13*a* and 13*b* ensure its tightness. In normal functioning, the fluid runs through the section 10 of duct as shown by the arrow A.

It will be noted that the rings 11*a* and 11*b* respectively are mounted on the ducts 12*a* and 12*b* and that after unscrewing, they release the section 10 of duct that than then be easily removed.

It will be noted that the section 10 of duct could also be assembled on the upstream and downstream ducts 12*a* and 12*b* by any suitable means, by gluing for example.

Advantageously, the section 10 of duct is made up of polyvinyl chloride.

The section 10 of duct has, in its upper part, a longitudinal horizontal plate 10*b* the upper surface of which is flat and that is pierced, through and through, with an oblong perforation 10*a* the ends of which are rounded in semi-circle. The dimensions of the opening 10*a* are equal, play taken into account, to the dimensions of the seat or subbase 21*a* of the base 21 of the unit 20.

When the heating unit 20 is mounted on the section 10 of duct, the lower surface of the seat or subbase 21*a* of the unit rests on the upper surface of the plate 10*b* of the section 10 of duct, and the centering member of seat 21*a* of the unit 20, is lodged inside the opening 10*a* of the section 10 of duct. The centering member of 21*a* ensures the centering of the unit 20 on the section 10 of duct.

As it may be seen in FIG. 4, threaded blind holes 10*c* are pieced on the upper surface of the plate 10*b*, along its periphery, and they can receive blocking screws (not shown) that ensure the fixation of the unit 20 on the section 10 of duct.

For the assembling of the unit 20 onto the section 10 of duct, this unit 20 is placed so that the linear parts of the immersible heaters 23*a*, 23*b* and 23*c* will be slightly slanted relative to the axis of the section 10 of duct, then the free ends of the immersible heaters 23*a*, 23*b* and 23*c* are made to penetrate inside the section 10 of duct. Then, while these ends are being moved toward the downstream end of the section 10 of duct, the slanting of the unit 20 is reduced up to the point at which it is possible to introduce its centering member into the opening 10*a*. Finally unit 20 is fixed onto the section 10 of duct.

It will be noted that during functioning, the immersible heaters 23*a*, 23*b* and 23*c* are located appreciably in the axis of the section 10 of duct, and they are then immersed in the heat-exchanging fluid that runs through the section 10 of duct. Thus they find themselves parallel with the direction of flow of the fluid, something that improves the thermal exchange between them and the fluid.

The slanted insertion of the immersible heaters 23*a*, 23*b* and 23*c* into the section 10 of duct, such as just explained, makes possible the use of immersible heaters that are longer than the base 21, as seen in FIG. 1.

In order to replace the immersible heaters 23*a*, 23*b* and 23*c* for other immersible heaters of a different power for example, the unit 20 is disassembled from the section 10 of duct, by executing in reverse order the above-described operations, then the support 22 is separated from the base 21. It is then possible to execute the replacement of immersible heaters, and then again to fix the assembly onto the section 10 of duct. The movable assembling of support 22 on the base 21 thus facilitates the interchangeability of the heating elements 23*a*, 23*b* and 23*c*.

Figure 5:
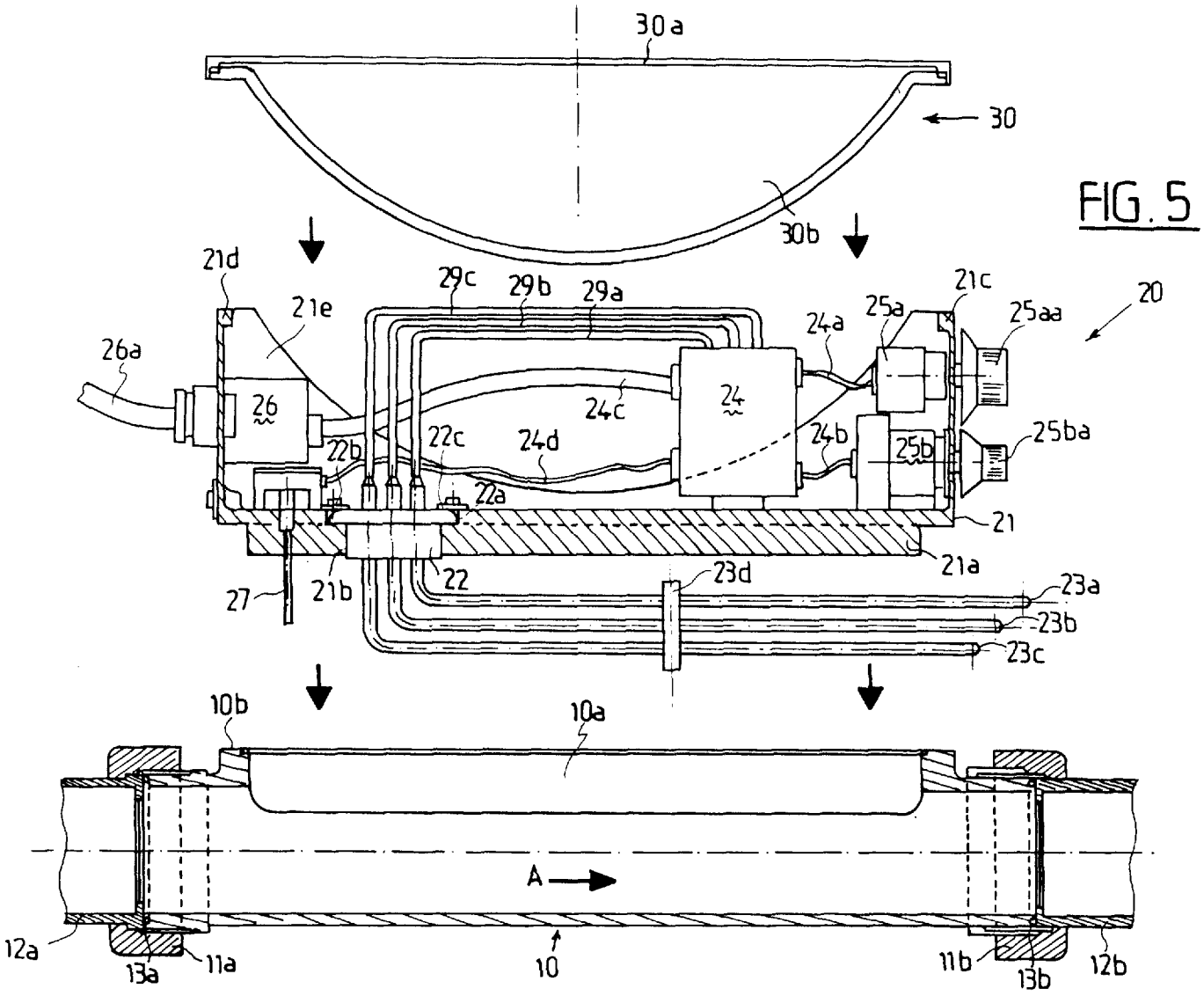
FIG. 5 is a section view along a median longitudinal plane, of a second mode of execution of an apparatus according to the present invention, the section of duct of this apparatus, the heating unit and its lid being shown in exploded view.

In the second example of execution of a heating apparatus according to the invention, (see FIG. 5), the heating unit 20 described above is mounted in identical manner on the section 10 of duct. The heating apparatus, however, comprises the following additional characteristics.

The immersible heaters 23*a*, 23*b* and 23*c* respectively are connected to the outputs of a governing and regulating unit 24 that is connected, on the upper face of the unit 20, by means of wires 29*a*, 29*b* and 29*c*. The unit 24 is connected to two regulating thermostats 25*a* and 25*b*, to a terminal box 26, and to a water rate of flow sensor 27. All of this equipment is lodged inside a casing closed at its upper part by a lid 30. The thermostats 25*a* and 25*b* are equipped with temperature sensors (not shown), the glove fingers of which are located inside the support 22.

The thermostats 25*a*, and 25*b* and their respective buttons 25*aa* and 25*bab* are placed on each side of one of the end walls 21*c* of the casing. They are respectively connected, by wires 24*a* and 24*b*, to adequate inputs of the unit 24 and they make it possible for the user to set the set values that regulate the water temperature.

The unit 24 is fed the line current via a wire 24*c*, a terminal box 26 affixed onto an end wall of the casing, and a wire 26*a*.

The sensor 27 is affixed to the seat or subbase 21*a* in such manner that it is submerged in the liquid running through the section 10 of duct, upstream from the immersion heaters 23*a*, 23*b* and 23*c*. It is connected to the casing 23 by means of a wire 24*d*.

Figure 3:
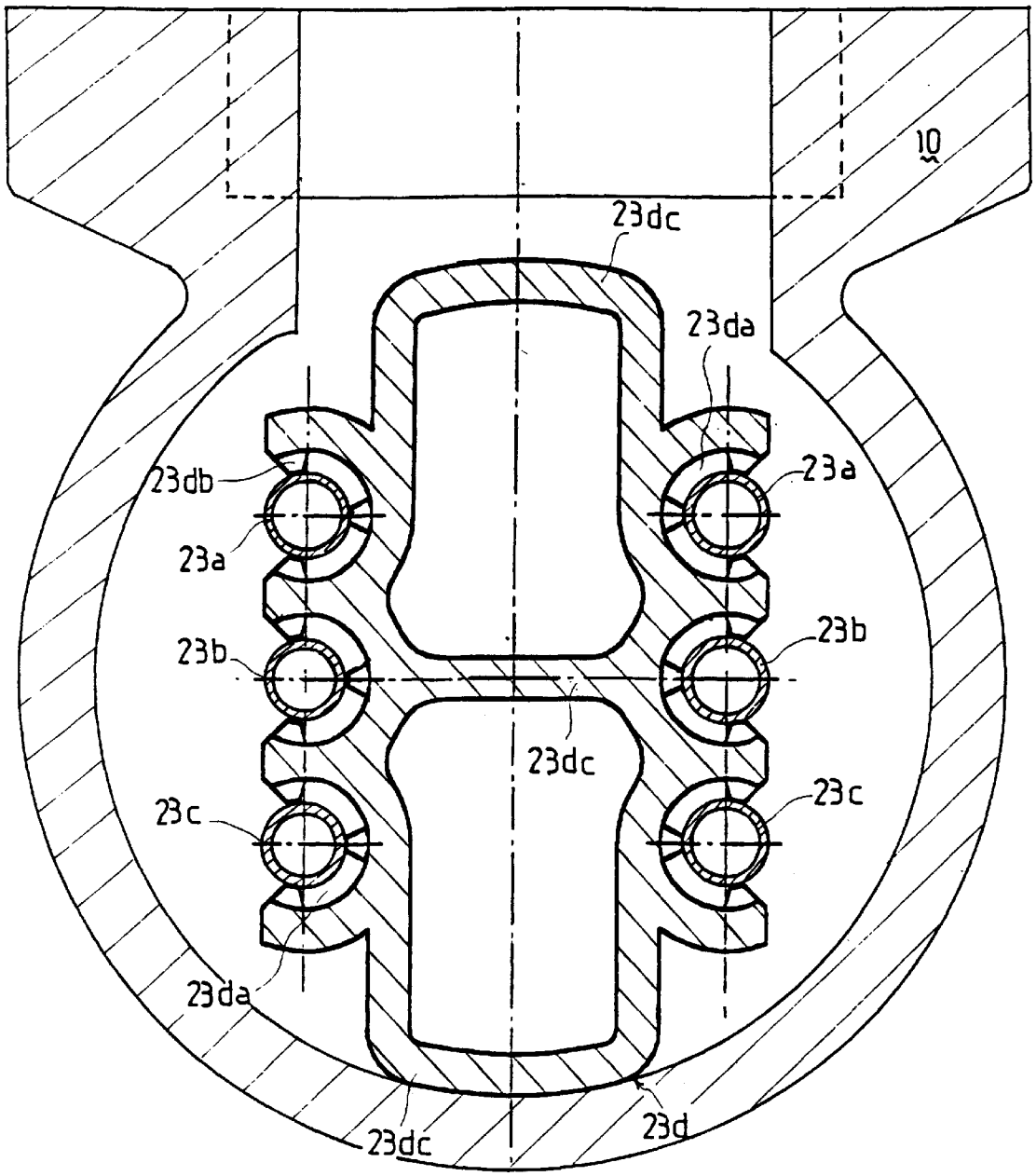
FIG. 3 is a section view, along III—III in FIG. 1, of a means to maintain the spacing between the different parts of the heating element.

The seat or subbase 21*a* is longitudinally equipped with two walls 21*e* of which only the first one is visible in FIG. 3. Each one of them has a curved-profile shape that takes on the complementary shape of the side 30*b* of lid 30.

It will be noted that the shape of lid 30, as well as the shape of the walls 21*e* is not functional, but only aesthetic.

During the setting into place of the lid, the rectangular plane 30*a* of this lid 30 is positioned, at its ends, on the summit edges of the two walls 21*e*. It is immobilized by screws (not shown). Only the two buttons 25*aa* and 25*ba* and the feed wire 26*a* remain visible externally to the base 21*a* (sic), in a space above its seat or subbase 21*a*.

I claim:

1. An electric apparatus for heating a circulating fluid for heating a pool of water, said apparatus comprising: an elongated duct (10) coupled to conduct said fluid, said duct (10) having a side opening (10*a*) therein and an upstream end connected to a intake duct (12*a*) and having a downstream end connected to a discharge duct (12*b*), said apparatus further comprising a plurality of elongated heating elements (23*a*, 23*b* and 23*c*), said elongated heating elements extending in a direction corresponding to the elongation of said elongated ducts, and a heating unit (20) including base (21) having an elongated dimension, said hearing elements (23*a*, 23*b*, 23*c*) being approximately parallel with the longitudinal dimension of said base (21), said heating unit (20) being mounted on said section of said first duct (10) so that said base (21) closes said opening (10*a*) in order to provide for the passage of said heating elements (23*a*, 23*b* and 23*c*) during an assembling of the heating unit (20) on said section (10) of duct, and a support (22) for said hearing elements (23*a*, 23*b* and 23*c*) movable mounted inside an opening (21*b*) of the base (21).

2. An apparatus according to claim 1 wherein said heating elements (23*a*, 23*b* and 23*c*) comprise a plurality of immersible heaters (23*a*, 23*b* and 23*c*).

3. An apparatus according to either claim 1 or 2, further comprising a unit (24) for governing and regulating said heating elements (23*a*, 23*b* and 23*c*), said unit (24) being mounted on the base (21).

4. An apparatus according to claim 3 further comprising a low water sensor (27), said base (21) being equipped with said low water sensor (27) which projects on the side of the heating elements (23*a*, 23*b* and 23*c*), said sensor being located upstream from the heating elements (23*a*, 23*b* and 23*c*) inside said section (10) of duct.

5. An apparatus according to one of the claims, 1 or 2 wherein said first duct (10) is connected to intake (12*a*) and discharge (12*b*) ducts by locking and unlocking means (11*a* and 11*b*).

* * * * *